US007021388B2

(12) United States Patent
Williams

(10) Patent No.: US 7,021,388 B2
(45) Date of Patent: Apr. 4, 2006

(54) FIBRE OPTIC WELL CONTROL SYSTEM

(75) Inventor: Glynn R. Williams, Hampshire (GB)

(73) Assignee: Schlumberger Technology Corporation

( * ) Notice: Subject to any disclaimer, the term of this patent is extended or adjusted under 35 U.S.C. 154(b) by 195 days.

(21) Appl. No.: 10/669,766

(22) Filed: Sep. 24, 2003

(65) Prior Publication Data

US 2004/0108118 A1 Jun. 10, 2004

(30) Foreign Application Priority Data

Sep. 26, 2002 (GB) ..... 0222357

(51) Int. Cl.
*E21B 27/00* (2006.01)

(52) U.S. Cl. ..... 166/372; 166/66.6

(58) Field of Classification Search ..... 166/250.15, 166/372, 117.5, 320, 66, 66.6
See application file for complete search history.

(56) References Cited

U.S. PATENT DOCUMENTS 5,892,860 A * 4/1999 Maron et al. ..... 385/12
6,070,608 A * 6/2000 Pringle ..... 166/117.5
6,281,489 B1 * 8/2001 Tubel et al. ..... 166/250.15

* cited by examiner

*Primary Examiner*—David Bagnell
*Assistant Examiner*—Matthew J. Smith
(74) *Attorney, Agent, or Firm*—Robert Van Someren; Bryan P. Galloway; Jaime A. Castano

(57) ABSTRACT

In a hydrocarbon production well, a control processor 32 selectively sends light to each of one or more gas lift valves 28 to cause injection of an injection fluid (such as nitrogen gas) from a pressurised annulus 22 into a production fluid (hydrocarbon) in production 18 tubing, and/or to each of one or more inlet valves 60, to control the rate of flow of the hydrocarbon (oil). The control processor 32 receives feedback data from sensors 48 54 50 66 near to each gas lift 28 or inlet 60 valve and otherwise provided in the well bore which measure pressure, temperature or flow rate. The sensors communicate by sensor fibre optic lines 42 which run in the well bore 10. The control processor 32 sends control signals by operating a laser light source to selectively to send laser light to each valve 28 60 through valve operating light fibres 36 which also run through the well bore 10. The valves 28 60 derive their motive power from the laser light using a photovoltaic cell array 58 which drives an actuator 68 which can be piezo electric, an electric motor or solenoid.

49 Claims, 4 Drawing Sheets

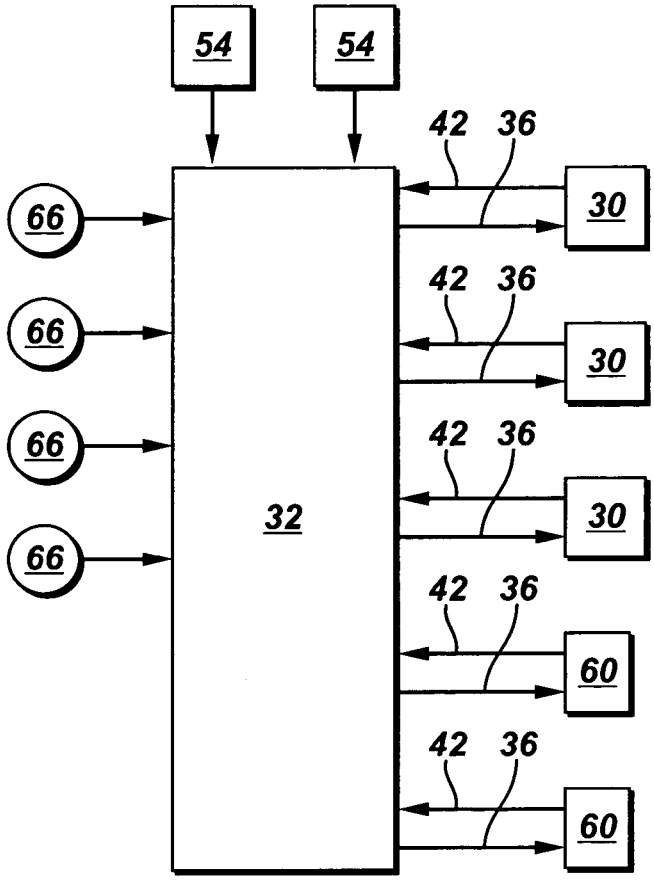
FIG. 5
FIG. 6
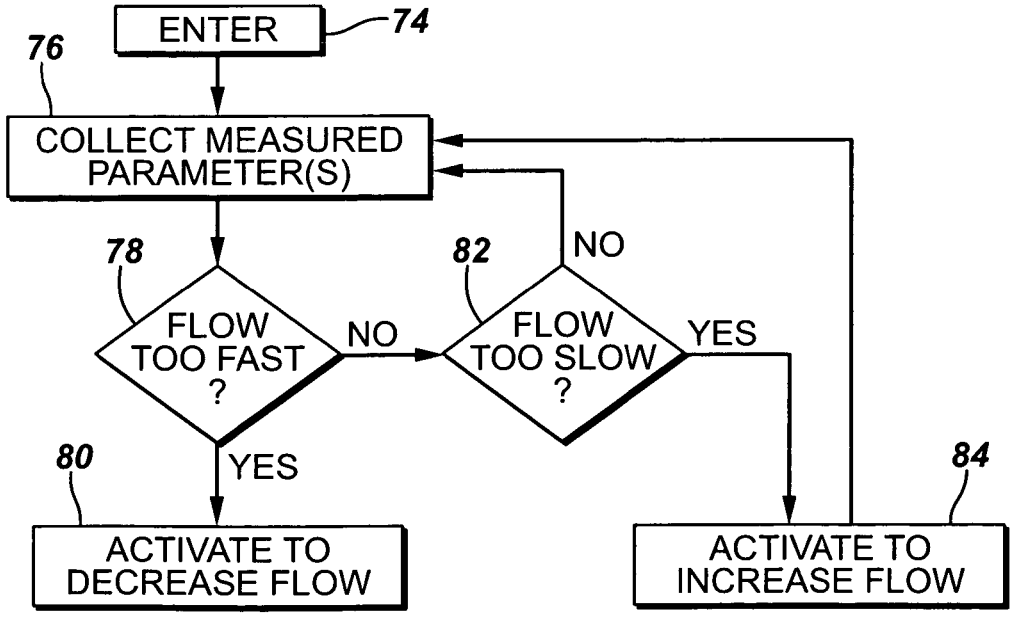

FIBRE OPTIC WELL CONTROL SYSTEM

CROSS REFERENCE TO RELATED APPLICATION

This claims the benefit under 35 U.S.C. § 119(a) of United Kingdom Application No. 0222357.6 entitled "Fibre Optic Well Control System," filed Sep. 26, 2002.

BACKGROUND

The present invention relates to the control of apparatus in a fluid production well, such as an oil or hydrocarbon production well, and includes the control of gas lift valves and flow control valves used in hydrocarbon production wells to assist in raising hydrocarbons towards the surface or to moderate the flow rate thereby to enhance production.

SUMMARY

Gas lift valves have been used for many years to assist the lifting of liquids from hydrocarbon (oil) wells. The valves allow the intermittent injection of gas into a well at high instantaneous rates so as to lift a column of fluid to the surface at regularly controlled time intervals. Gas lift valves are used for a variety of purposes. These include unloading wells, for continuous flow production, for intermittent flow production, for the removal of water and condensate from gas wells, and for the injection of chemical corrosion inhibitors. The operation of all gas lift valves is governed by the same principles. The valve is equipped with a pressure sensitive spring element which measures the pressure difference between the gas filled annulus and the pressure of fluid flow in the production tubing. When the pressure differential exceeds a predetermined value, the valve will open and allow gas into the fluid filled production tubing. The most significant recent advances in gas lift technology have been the development of techniques that allow accurate calculation of pressures in a flowing well using surface production data. Accurate knowledge of this pressure gradient allows a number of preset valves to be placed at various depths in the production tubing and these valves operate remotely when pressurised gas is injected into the annulus. However, with current valve models, errors do occur which, over a period of time, may lead to substantial cumulative inefficiencies. Such inefficiencies may result in excess injection of gas into the fluid stream, giving rise to less than optimum recovery of hydrocarbon from the well. The facilities required for separating and compressing the gas for gas lift operations are often the highest cost element of such systems.

In the face of continuously increasing production costs, a demand exists for improved techniques and efficiency in gas lift operations. The present invention seeks to overcome deficiencies in current gas lift systems, namely their reliance on mathematical models to estimate the pressure gradient in the production tubing and the remote, uncontrolled method of operating the gas lift valves. The present invention seeks to provide a method and apparatus for controlling apparatus in a hydrocarbon production well, particularly apt for use with gas lift operations where the quantity of released gas, and the pressure whereat the gas is released, remains reliably controlled. The present invention further seeks to provide a remotely operated system without the attendant alteration of component behaviour with time. The present invention further seeks to provide a remotely operable system for controlling fluid valves and other apparatus free from encumbrance of electrical cables. The present invention further seeks to provide a method and system for normal valve and gas lift valve operations allowing automated continuous control.

According to a first aspect, the present invention consists in a system for controlling the flow of a production fluid in a well bore, said system comprising: a flow rate influencing device within the well bore, operable to influence the rate of flow of the production fluid; monitoring means operative to measure one or more parameters at one or more locations within the well bore and to provide output indicative of said one or more parameters; and feedback control means, coupled to receive said output of said monitoring means and operative, responsively to said output of said monitoring means, to provide control signals to said flow rate influencing device to control the flow of the production fluid.

According to a second aspect, the present invention consists in a method for controlling the flow of a production fluid in a well bore, said method comprising the steps of: employing a flow rate influencing device within the well bore to influence the rate of flow of the production fluid; employing monitoring means to measure one or more parameters at one or more locations within the well bore and to provide output indicative of said one or more parameters; and employing feedback control means to receive said output from said monitoring means, and to respond to said output of said monitoring means by providing control signals to said flow rate influencing device to control the flow of the production fluid.

The invention further provides that the flow rate influencing device can operate selectably either to encourage the flow of production fluid in the well bore or not to encouraging to flow of production fluid in the well bore, and that the said control signals can either activate or deactivate the device.

The invention further provides that the flow rate influencing device can provide a continuous influence on the flow of production fluid in the well bore, and that the control signals can cause the device to provide a selectable level of influence.

The invention further provides that the control means can comprise means to operate a laser light source, light from the laser light source being coupled as the control is signal to control and power the operation of the flow rate influencing device.

The invention further provides that the flow rate influencing device can comprise a photovoltaic converter for receiving the light from the laser light source and for converting the light from the laser light source into motive power for the device.

The invention further provides that the output from the photovoltaic converter can be coupled to: one or more piezo electric devices, operative to provide displacement when activated; to an electric motor, coupled to operate the device; or to a solenoid, coupled to operate the device.

The invention further provides that coupling of the output of the monitoring means to the control means can include the use of one or more sensor optic fibres extending within the well bore.

The invention further provides that provision of the control signals from the control means to the flow rate influencing device can include the use of a control optic fibre within the well bore.

The invention further provides that the one or more parameters can include pressure, temperature or flow rate.

The invention further provides that the flow rate influencing device can be one or more valves in the well bore.

The invention further provides that the flow rate influencing device can be one or more gas lift valves in the well bore.

The invention further provides that the production fluid can be contained within a first zone of the well bore, that an injection fluid can be held within a second zone in the well bore, and that the gas lift valve can allow passage of the injection fluid, from the second zone into the first zone to mix with the production fluid.

The invention further provides that the injection fluid can be a gas, corrosion preventative, a flushing fluid or a diluent fluid The invention further provides that the production fluid can be a hydrocarbon, that the well bore can be part of a hydrocarbon production well, and that the hydrocarbon can be oil or natural gas.

The invention is further explained, by way of example, by the following description, taken in conjunction with the appended drawings, in which:

BRIEF DESCRIPTION OF THE DRAWINGS

FIG. 5 is a schematic diagram showing a further embodiment of the invention where a plurality of types of devices are controlled and a plurality of sensor inputs of different types are also provided.

FIG. 6 is a flow chart showing one way in which the control processor of all of the previous figures can control the flow in a hydrocarbon well.

DETAILED DESCRIPTION

Figure 1:
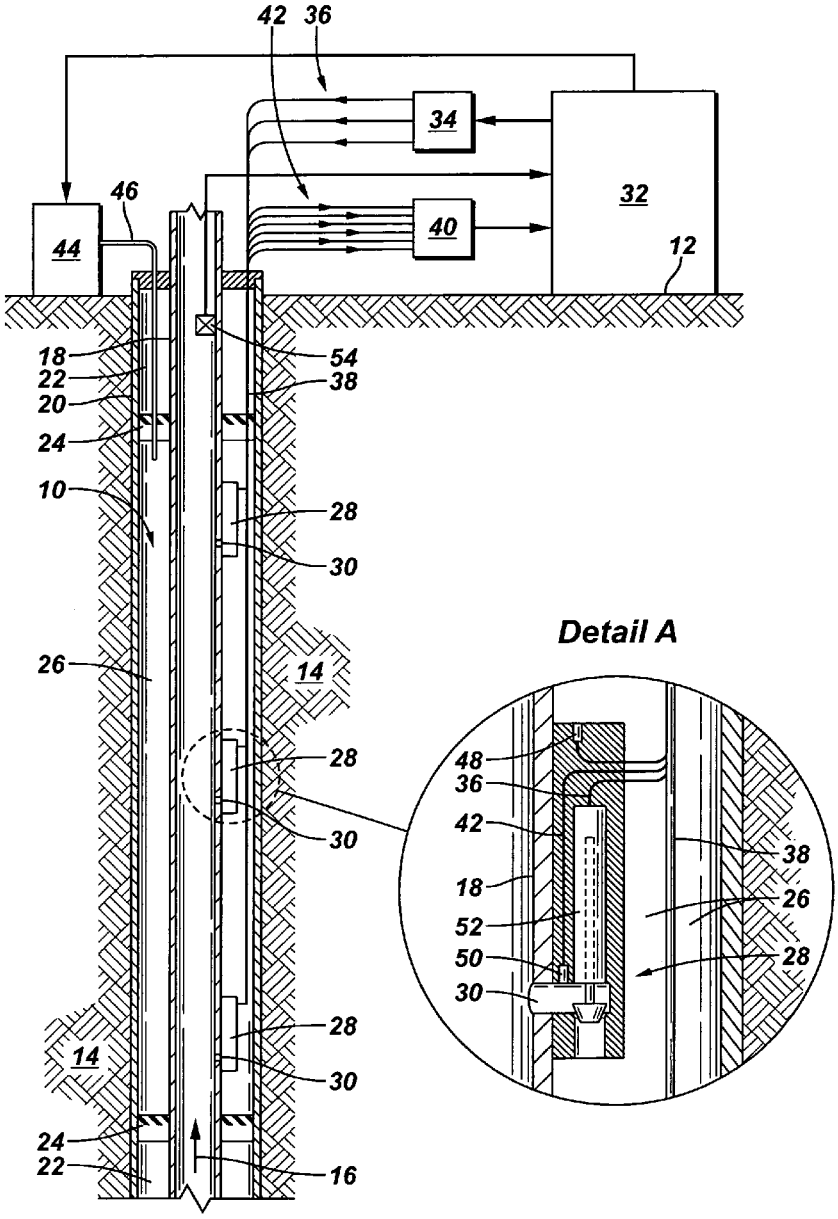
FIG. 1 is a cross sectional schematic view of a hydrocarbon production well incorporating the present invention.

Attention is first drawn to FIG. 1, showing a schematic cross sectional view of a hydrocarbon production well incorporating the present invention.

A well bore 10 passes from the surface 12 through surrounding rock 14 towards hydrocarbon bearing rock (not shown) from which hydrocarbon is extracted as indicated by arrow 16 up production tubing 18 towards the surface 12. The well bore 10 is lined by a cylindrical liner 20 through which the production tubing 18 passes substantially concentrically. An annular cylindrical void (the annulus) 22 is formed by the outer surface of the tubing 18 and the inner surface of the liner 20. A packer 24 is placed at the upper and lower ends of a gas lift section 26 of the annulus 22 to provide a pressure and fluid seal between the gas lift section 26 of the annulus 22 and the parts of the annulus 22 there above and there below. Gas injection stations 28 are spaced at known intervals on the surface of the production tubing 18 in the gas lift section 26 of the annulus 22 and each gas injection station 28 has a gas injection port 30 opening into the production tubing 18.

At the surface 12, a control processor 32 sends operating instructions, concerning power level, timing and duration of operation, to a laser light source 34 which selectably and controllably provides laser light into valve operating light fibres 36, one of which is supplied to each gas injection port 30 through a fibre optic bundle 38 which passes down the annulus 22 and through a packer 24 into the gas lift section 26. The control processor 32 receives sensor input from a sensor receiver 40 which receives sensor information from each of the gas injection stations 28 via sensor fibre optic lines 42 in the fibre optic bundle 38. The control processor 32 also provides operating commands to gas plant 44 which provides gas at controllable pressures and quantities through a gas pipe 46 which passes through a packer 24 into the gas lift section 26 of the annulus 22 to pressurise the gas lift section 26.

Magnified detail A shows schematic detail of a gas injection station 28. An annulus pressure and temperature sensor unit 48 measures the pressure and temperature in the gas lift section 26 of the annulus (at that gas injection station 28) and relays it back to the sensor receiver 40 via one or more sensor fibre optic lines 42 in the fibre optic bundle 38. A tubing pressure and temperature sensor unit 50 measures the pressure and temperature in the production tubing at that gas injection station 28 and relays it back to the sensor receiver 40 via one or more sensor fibre optic lines 42 in the fibre optic bundle 38. An optically controlled gas release valve 52 (here shown only in schematic detail) can be opened (proportionally or non-proportionally) upon reception of laser light from its respective valve operating light fibre 36 to allow gas to pass from the gas lifting section 26 of the annulus 22, through the gas injection port 30, into the fluid in the production tubing 18 adjacent to the gas injection station 28.

Flow monitoring equipment 54, to complete the system, relays flow data, and gas and fluid analysis, to the control processor 32.

Figure 2:
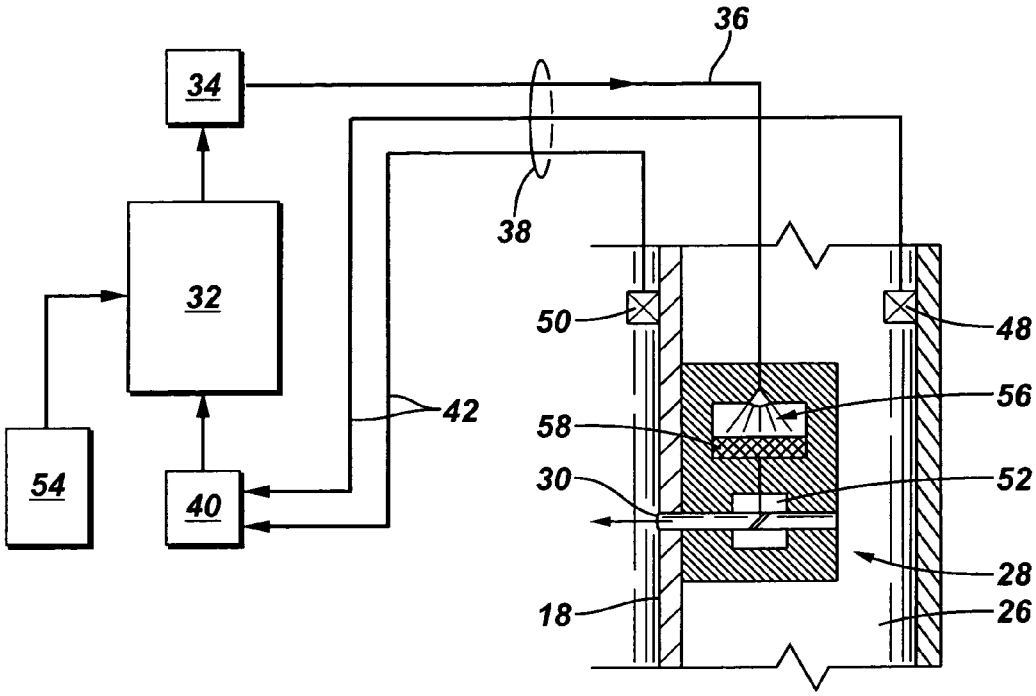
FIG. 2 is a schematic diagram showing the control connections of FIG. 1.

FIG. 2 is a more schematic and, hopefully, clearer diagram of the connectivity shown in FIG. 1. The laser light source 34 connects via the valve operating light fibre 36 in the fibre optic bundle 38 with the gas injection station 28 which attached on the outside of production tubing 18. The annulus pressure and/or temperature sensor unit 48 and the tubing pressure and/or temperature sensor unit 50 connects to the senor receiver 40 through the fibre optic lines 42. The flow monitoring equipment 54 connects directly to the control processor 32 and the decoded output of the sensor receiver 40 also connects to the control processor 32. The control processor, in turn, controls the activity of the laser light source 34.

As can be seen, each gas injection station 28 is, in effect, in a servo-feedback loop with the control processor 34 as the compensating, decision making and controlling element, feedback being provided via the flow monitoring equipment and sensors 48 50 and correction being provided via the valve operating light fibre 36. The control processor 34 is, in fact, connected to a plurality of gas injection stations 28, all of which the control processor is operative to control simultaneously, by operating none, some or all of the plural gas injection stations.

The gas injection station 28 comprises means to spread rays of light 56 from the valve operating light fibre 36 over a photovoltaic cell array 58 whose output is employed to drive the optically controlled gas release valve 52. The output of the photovoltaic cell array 58, in this example, is for preference applied across discs of piezo-electric material, such as Lead Zinc Titanate (PZT) to make a force convertor which can generate sufficient force to open the optically controlled gas release valve 52 against pressures of many millions of Pascals. This, however, is not the only means whereby the output of the photovoltaic cell array 58 can be employed. In another embodiment, the output voltage and current can be used to drive a motor, preferably with a gearbox, to operate an optically controlled gas release valve 52. Other schemes involve use of solenoids, ratchet mechanisms and separately operable release mechanisms to work a valve 52. The principal feature of the gas injection station 28, in the present invention, is that it derives its control and motive power solely from a laser light source 34 driving an optical fibre 36.

Figure 3:
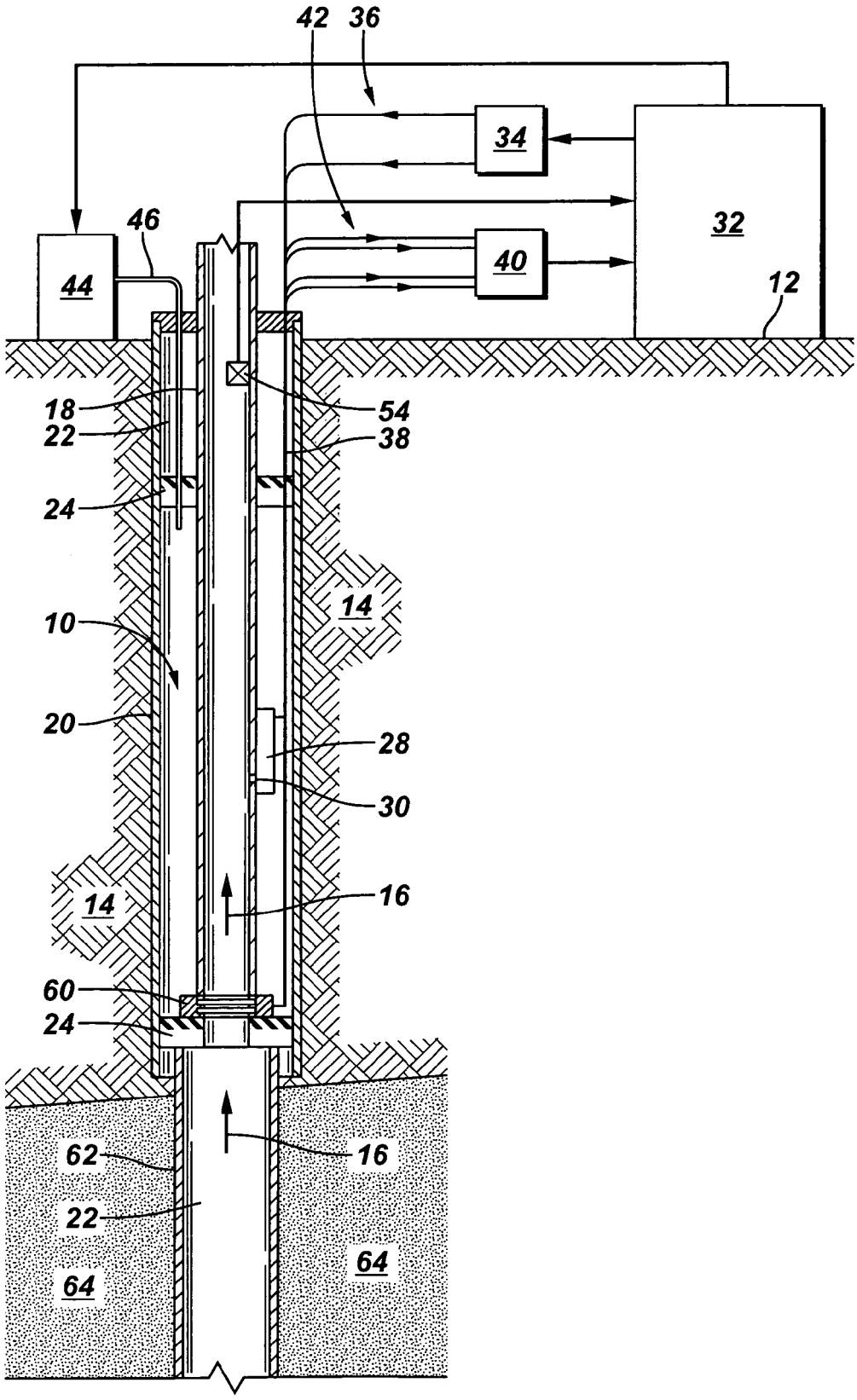
FIG. 3 is a diagram of a hydrocarbon production well showing the present invention, incorporating a flow rate control valve.

Attention is next drawn to FIG. 3 showing a further embodiment of the present invention, employed in a hydrocarbon production well.

FIG. 3 is an extension of and modification to FIG. 1 and like numbers denote like items.

As well as a gas injection port 30, the apparatus further comprises a tubing valve 60 which is placed between the production tubing 18 and a production liner 62 which permits (or does not permit) oil or other hydrocarbons to pass, depending on its configuration, between the production liner 62 and the production tubing 18 thus to proceed up the well bore 10, the production liner 62 and the annular region between the packers 24, or between the annular region between the packers 24 and the production tubing 18. The tubing valve 60 is monitored and controlled, in much the same manner as the gas injection port 30, via the fibre optic bundle 38 which sends light from the laser light source 34 to the production tubing inlet valve and sends information from sensors in the vicinity of the production tubing inlet tubing valve 60 back to a control processor 32. In some embodiments, the tubing valve 60 may be a sleeve valve, ball valve, or disc valve, depending on the requirements. In other embodiments, tubing valve 60 is generally configured as gas release valve 52.

Although the tubing valve 60 is shown at the bottom of the production tubing 18, it is to be appreciated that one, two or more such valves may be distributed along the production tubing 18 (or elsewhere in the well bore 10) to provide more than one point of control of the flow of oil or other hydrocarbon in the production tubing 18 or well bore 10.

Figure 4:
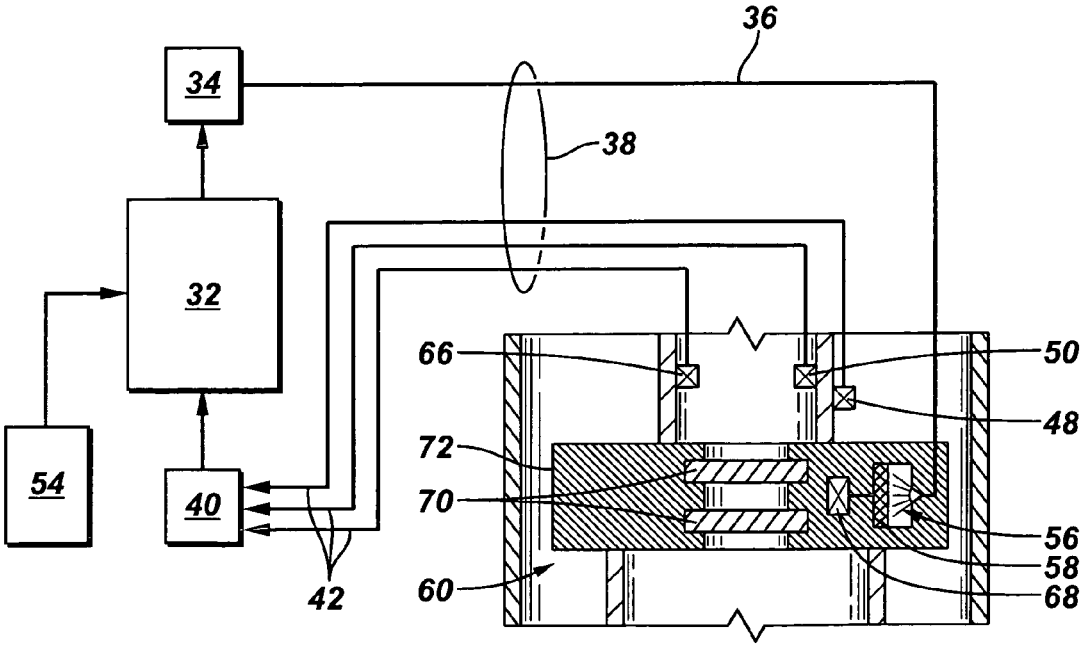
FIG. 4 is a schematic diagram showing the control connections of FIG. 3.

Attention is drawn to FIG. 4, showing a simplified and clearer representation of the connectivity for the tubing valve 60, otherwise shown in FIG. 3. FIG. 4 is very similar to FIG. 2, and like numbers denote like items.

The tubing valve 60 is powered from the valve operating light fibre 36 by the rays of light 56 irradiating a photovoltaic cell array 58 as before. The photovoltaic cell array 58 drives a ram assembly 68 which can, as before, be piezoelectric, motor or solenoid driven. The ram assembly 68 moves valve plates 70 in a valve housing 72.

The style of tubing valve, here shown, is only by way of a single example from many possibilities. The valve plates 70, in this example, may comprise holes which can align or mis-align to allow through movement or to deny through movement of hydrocarbons. The production tubing inlet valve 60 can also be a sleeve valve which, for example, can be concentric with and moving on the inner surface or the outer surface of the production tubing 18, or any other circular or tubular member which can be interposed to provide a controllable impediment to the flow of hydrocarbons.

The control processor 32, together with the tubing valve 60 and the sensors 56, 48, 66 provide a closed loop feedback system where the tubing valve 60 can be used to control the flow of hydrocarbons in the production tubing 18 to reach the surface 12, or as previously described. The additional sensors 60, here represented by a single item, can be any other sensors for measuring any other parameter connected with the hydrocarbon well and whose output can be included in estimating or measuring the instant performance of the hydrocarbon well.

Attention is drawn to FIG. 5 which shows how a control processor 32 can be connected to at least one, but in this example, a plurality of gas injection ports 30, tubing valves 60, flow monitoring equipment 54 and additional sensors 66 which can monitor parameters such as pressure, temperature, chemical properties and indeed anything that can be measured in a hydrocarbon well. In another embodiment, control processor 32 can be connected with such equipment located in different wells, such as related injection and production wells.

Finally, FIG. 6 shows one way in which the control processor 32 can control a gas injection port 30 or a valve 60.

From entry 74 a first operation 76 has the control processor 32 measure the parameters from the different sources 48, 50, 66, 54 from which data can be collected. A first test 78 checks to see if the flow of hydrocarbons in the production tubing 18 is too fast. If it is, a second operation 80 activates the device to slow the flow rate. For example, if the device is a gas injection port 30, the flow of gas therethrough is stopped. If the device is a valve 60, the valve is closed. The second operation 80 returns control back to the first operation 76 where the control processor 32 collects parameters.

If the first test 78 does not detect that the flow is too fast, a second test 82 checks to see if the flow is too slow. If it is, a third operation 84 activates the control device so that gas injection ports 30 allow the through passage of gas and valves 60 are opened. Control passes to the first operation 76.

While FIG. 6 shows an example of on/off control, the control can be rendered proportional, including devices which are capable of proportional or continuous operation, or by using devices which, although of an on/off nature, can be rendered pseudo-proportional by varying the ratio of on time to off time. For instance, any of the valves described herein can be opened or closed gradually from fully closed to fully opened by varying the flow through the valve apertures. Fiber optic controlled valves are specially useful for such graduated control, which in conjunction with the continuous feedback mechanism and control processor 32, act to optimize the flow therethrough. An operator can also set the control processor 32 so that it optimizes flow through the valves at a certain rate or pegged to a certain parameter.

The present invention allows the control processor 32 actually to monitor and record the conditions in the production tubing, to control the gas pressure supplied in the gas lift section 26 of the annulus 22, and to open and close the gas release valves 52 and tubing valves 60 under selectable conditions and at selectable times. By controlling the intensity of the laser light delivered to the photovoltaic cell array 58, the voltage delivered to the motors, solenoids or piezo electric discs 60 can also be varied to control the extent of operation. All this is achieved without hydraulic lines or electrical cable having to be passed down the confined space of the annulus 22 and with the minimum of penetrations through the packer 24. The system, described, allows for closed loop control of the gas lift process and offers long term reliability and adaptability in the face of changing conditions with a well bore 10.

The gas of preference, for inclusion in the gas lift section, is nitrogen, but any other gas can be used. Other fluids can also be used, such as corrosion inhibitors, solvents or diluents. While the invention has been shown as an example relating to hydrocarbon wells, it can equally be applied to any other fluid confined within a conduit, and can include use in the raising and pumping of water, or any chemical or solution in an industrial environment. The invention can also be embodied using any other piezo-electric material apt for such employment.

The invention is further clarified by the following claims.

What is claimed is:

1. A valve system for use in a wellbore, comprising:

an optical fiber extending into a wellbore, the optical fiber adapted to transmit light at varying intensities;

a valve having a variable orifice that has at least one setting between an open and a closed position;

the optical fiber functionally connected to the valve; and wherein the valve is activated by the light and the setting of the variable orifice is controlled by the intensity of the light.

2. The valve system of claim 1, wherein the valve comprises a gas lift valve.

3. The valve system of claim 1, wherein the valve comprises a tubing valve.

4. The valve system of claim 1, wherein the valve comprises a photovoltaic converter for receiving the light and for converting the light into motive power for the variable orifice.

5. The valve system of claim 4, wherein output from the photovoltaic converter is coupled to one or more piezo electric devices, operative to provide displacement when activated.

6. The valve system of claim 4, wherein output from the photovoltaic converter is coupled to an electric motor, coupled to operate the variable orifice.

7. The valve system of claim 4, wherein output from the photovoltaic converter is coupled to a solenoid, coupled to operate the variable orifice.

8. The valve system of claim 1, wherein the variable orifice has a plurality of settings between an open and a closed position.

9. A system for controlling the flow of fluid in a wellbore, comprising:

a gas lift valve having a variable orifice with at least one setting between an open and a closed setting, the gas lift valve being deployed in a wellbore and being adapted to influence the flow of fluid in the wellbore;

an optical fiber functionally connected to the gas lift valve;

a control unit functionally connected to the optical fiber to transmit light through the optical fiber and to the gas lift valve;

the gas lift valve being activated and controlled by the light transmitted through the fiber, the setting of the variable orifice being controlled by the intensity of the light;

a monitoring unit operative to measure one or more parameters at one or more locations within the wellbore; and the control unit functionally connected to the monitoring unit and to the gas lift valve, wherein the gas lift valve is activated and controlled by the control unit depending on output received from the monitoring unit.

10. The system of claim 9, wherein the control unit comprises a laser light source to transmit the light through the optical fiber.

11. The system of claim 9, wherein the gas lift valve comprises a photovoltaic converter for receiving the light and for converting the light into motive power for the variable orifice.

12. The system of claim 9, wherein the control unit is functionally connected to the monitoring unit through an additional optical fiber.

13. The system of claim 9, wherein the one or more parameters comprises pressure.

14. The system of claim 9, wherein the one or more parameters comprises temperature.

15. The system of claim 9, wherein the one or more parameters comprises flow rate.

16. The system of claim 9, wherein the gas lift valve controls the injection of an additional fluid into a tubing.

17. The system of claim 16, wherein the injection of the additional fluid into the tubing aids in extracting the fluid from the wellbore.

18. The system of claim 16, wherein the additional fluid comprises a gas.

19. The system of claim 16, wherein the additional fluid comprises a corrosion preventative.

20. The system of claim 16, wherein the additional fluid comprises a flushing fluid.

21. The system of claim 16, wherein the additional fluid comprises a diluent fluid.

22. The system of claim 16, wherein the control unit is functionally connected to an injection plant that injects the additional fluid into the tubing and wherein the control unit controls the conditions under which the additional fluid is injected into the tubing.

23. The system of claim 22, wherein the control unit controls the conditions under which the additional fluid is injected into the tubing depending on output received from the monitoring unit.

24. The system of claim 9, further comprising:

a plurality of gas lift valves deployed in the wellbore adapted to influence the flow of fluid in the wellbore;

a control unit functionally connected to the gas lift valves through at least one optical fiber and adapted to transmit light through the at least one optical fiber and to the gas lift valves;

the gas lift valves being activated and controlled by the light transmitted through the fiber;

the control unit functionally connected to the monitoring unit and to the gas lift valves, wherein the gas lift valves are activated and controlled by the control unit depending on output received from the monitoring unit.

25. The system of claim 24, further comprising:

a plurality of monitoring units;

each monitoring unit functionally connected to the control unit; and wherein the gas lift valves are activated and controlled by the control unit depending on output from received from the monitoring units.

26. The system of claim 9, further comprising:

at least one tubing valve functionally connected to the control unit; and wherein the at least one tubing valve is activated by the control unit depending on output from the monitoring unit.

27. The system of claim 26, wherein the at least one tubing valve is placed between a production tubing and a production liner.

28. The system of claim 26, wherein the at least one tubing valve is functionally connected to the control unit via an optical fiber.

29. A system for controlling the flow of fluid in a wellbore, comprising:

a gas lift valve deployed in a wellbore adapted to influence the flow of fluid in the wellbore;

an optical fiber functionally connected to the gas lift valve;

a control unit functionally connected to the optical fiber to transmit light through the optical fiber and to the gas lift valve;

the gas lift valve being activated and controlled by the light transmitted through the fiber, the gas lift valve comprising a photovoltaic converter for receiving the light and for converting the light into motive power for the variable orifice;

a monitoring unit operative to measure one or more parameters at one or more locations within the wellbore; and the control unit functionally connected to the monitoring unit and to the gas lift valve, wherein the gas lift valve is activated and controlled by the control unit depending on output received from the monitoring unit, wherein output from the photovoltaic converter is coupled to one or more piezo electric devices, operative to provide displacement when activated.

30. A system for controlling the flow of fluid in a wellbore, comprising:

a gas lift valve deployed in a wellbore adapted to influence the flow of fluid in the wellbore;

an optical fiber functionally connected to the gas lift valve;

a control unit functionally connected to the optical fiber to transmit light through the optical fiber and to the gas lift valve;

the gas lift valve being activated and controlled by the light transmitted through the fiber, the gas lift valve comprising a photovoltaic converter for receiving the light and for converting the light into motive power for the variable orifice;

a monitoring unit operative to measure one or more parameters at one or more locations within the wellbore; and the control unit functionally connected to the monitoring unit and to the gas lift valve, wherein the gas lift valve is activated and controlled by the control unit depending on output received from the monitoring unit, wherein output from the photovoltaic converter is coupled to an electric motor, coupled to operate the gas lift valve.

31. A system for controlling the flow of fluid in a wellbore, comprising:

a gas lift valve deployed in a wellbore adapted to influence the flow of fluid in the wellbore;

an optical fiber functionally connected to the gas lift valve;

a control unit functionally connected to the optical fiber to transmit light through the optical fiber and to the gas lift valve;

the gas lift valve being activated and controlled by the light transmitted through the fiber, the gas lift valve comprising a photovoltaic converter for receiving the light and for converting the light into motive power for the variable orifice;

a monitoring unit operative to measure one or more parameters at one or more locations within the wellbore; and the control unit functionally connected to the monitoring unit and to the gas lift valve, wherein the gas lift valve is activated and controlled by the control unit depending on output received from the monitoring unit, wherein output from the photovoltaic converter is coupled to a solenoid, coupled to operate the gas lift valve.

32. A method for controlling the flow of fluid in a wellbore, comprising:

influencing the flow of fluid in a wellbore by deploying a gas lift valve in the wellbore;

functionally connecting the gas lift valve and a control unit to an optical fiber;

transmitting light from the control unit through the optical fiber and to the gas lift valve;

measuring one or more parameters with a monitoring unit at one or more locations within the wellbore;

transmitting output from the monitoring unit to the control unit; and activating and controlling the gas lift valve to adjust the gas lift valve to a position selected from at least three possible positions, the movement of the gas lift valve depending on the output received by the control unit from the monitoring unit and being in response to the light transmitted by the control unit through the fiber.

33. The method of claim 32, further comprising receiving the light in a photovoltaic converter and converting the light into motive power for the gas lift valve.

34. The method of claim 32, wherein the one or more parameters comprises pressure.

35. The method of claim 32, wherein the one or more parameters comprises temperature.

36. The method of claim 32, wherein the one or more parameters comprises flow rate.

37. The method of claim 32, further comprising controlling the injection of an additional fluid into a tubing by use of the gas lift valve.

38. The method of claim 37, wherein the injection of the additional fluid into the tubing aids in extracting the fluid from the wellbore.

39. The method of claim 37, wherein the additional fluid comprises a gas.

40. The method of claim 37, wherein the additional fluid comprises a corrosion preventative.

41. The method of claim 37, wherein the additional fluid comprises a flushing fluid.

42. The method of claim 37, wherein the additional fluid comprises a diluent fluid.

43. The method of claim 37, further comprising functionally connecting the control unit to an injection plant that injects the additional fluid into the tubing and controlling the conditions under which the additional fluid is injected into the tubing by use of the control unit.

44. The method of claim 43, further comprising controlling the conditions under which the additional fluid is injected into the tubing depending on output received by the control unit from the monitoring unit.

45. The method of claim 32, further comprising:

deploying a plurality of gas lift valves in the wellbore adapted to influence the flow of fluid in the wellbore;

functionally connecting the control unit to the gas lift valves through at least one optical fiber;

transmitting light from the control unit through the at least one optical fiber and to the gas lift valves;

activating and controlling the gas lift valves depending on the output received by the control unit from the monitoring unit and in response to the light transmitted by the control unit through the fiber.

46. The method of claim 45, further comprising:

functionally connecting a plurality of monitoring units to the control unit;

activating and controlling the gas lift valves depending on the output received by the control unit from the monitoring units and in response to the light transmitted by the control unit through the fiber.

47. The method of claim 32, further comprising:

functionally connecting at least one tubing valve to the control unit; and activating the at least one tubing valve depending on output from the monitoring unit.

48. The method of claim 47, further comprising deploying the at least one tubing valve between a production tubing and a production liner.

49. The method of claim 47, further comprising functionally connecting the at least one tubing valve to the control unit via an optical fiber.

* * * * *